US005852884A

United States Patent [19]

Miotto

[11] Patent Number: 5,852,884

[45] Date of Patent: Dec. 29, 1998

[54] BOOT FOR SPORTING ACTIVITIES

[75] Inventor: Onorio Miotto, Mosnigo Di Moriago Della Battaglia, Italy

[73] Assignee: AM S.r.L., Della Battaglia, Italy

[21] Appl. No.: 913,526

[22] PCT Filed: Feb. 5, 1996

[86] PCT No.: PCT/EP96/00461

§ 371 Date: Sep. 19, 1997

§ 102(e) Date: Sep. 19, 1997

[87] PCT Pub. No.: WO96/31137

PCT Pub. Date: Oct. 10, 1996

[30] Foreign Application Priority Data

Apr. 3, 1995 [IT] Italy ..... VE950011 U

[51] Int. Cl.[6] ..... A43B 7/08; A43B 5/16

[52] U.S. Cl. ..... 36/3 A; 36/115; 36/50.5

[58] Field of Search ..... 36/3 A, 50.5, 115

[56] References Cited

U.S. PATENT DOCUMENTS

| | | |
|---|---|---|
| 4,449,273 | 5/1984 | Baggio . |
| 5,171,033 | 12/1992 | Olsen et al. . |
| 5,357,695 | 10/1994 | Lu . |
| 5,365,679 | 11/1994 | Chemello . |
| 5,381,611 | 1/1995 | Tonel et al. . |
| 5,491,911 | 2/1996 | Chen . |
| 5,592,722 | 1/1997 | Foscaro et al. . |

FOREIGN PATENT DOCUMENTS

| | | |
|---|---|---|
| 0260874 | 3/1988 | European Pat. Off. . |
| 0465222 | 1/1992 | European Pat. Off. . |
| 4128704 | 3/1993 | Germany . |

*Primary Examiner*—Ted Kavanaugh
*Attorney, Agent, or Firm*—Hoffman, Wasson & Gitler

[57] ABSTRACT

A boot for sporting activities, having on one side a plurality of aeration through holes forming engagement elements for an appendix of a tractive element (6) fixed to a lever (5) mounted on the other side of the vamp.

9 Claims, 2 Drawing Sheets

BOOT FOR SPORTING ACTIVITIES

This is a 371 of PCT/EP96/00461 filed Feb. 5, 1996.

FIELD OF THE INVENTION

This invention relates to a boot for sporting activities.

DESCRIPTION OF THE PRIOR ART

Boots for sporting activities, generally for skating, cross-country skiing, downhill skiing etc. are known. They generally comprise a rigid plastic shell provided internally with a padding of spongy material. On its front part the shell is provided with a plurality of fastening members consisting generally of levers rigid with one side of the shell and provided with a tractive strap to be engaged in a suitable pawl-type coupling element provided on the other side of the shell.

To facilitate foot transpiration the shell is provided with a plurality of holes enabling the air within the shell to be changed.

These known boots have however certain drawbacks, and in particular:

a high cost due to the provision of the coupling element for the tractive member, the presence of holes which are always open, even in the cold season when foot transpiration is not required, the impossibility of adjusting this transpiration.

BRIEF SUMMARY OF THE INVENTION

According to the invention all these drawbacks are eliminated through a boot for sporting activities, comprising on one side a plurality of aeration through holes forming engagement elements for an appendix of a tractive element fixed to a lever mounted on the other side of the vamp.

BRIEF DESCRIPTION OF THE DRAWINGS

The present invention is further clarified hereinafter with reference to the accompanying drawings, in which.

DESCRIPTION OF PREFERRED EMBODIMENTS

Figure 1:
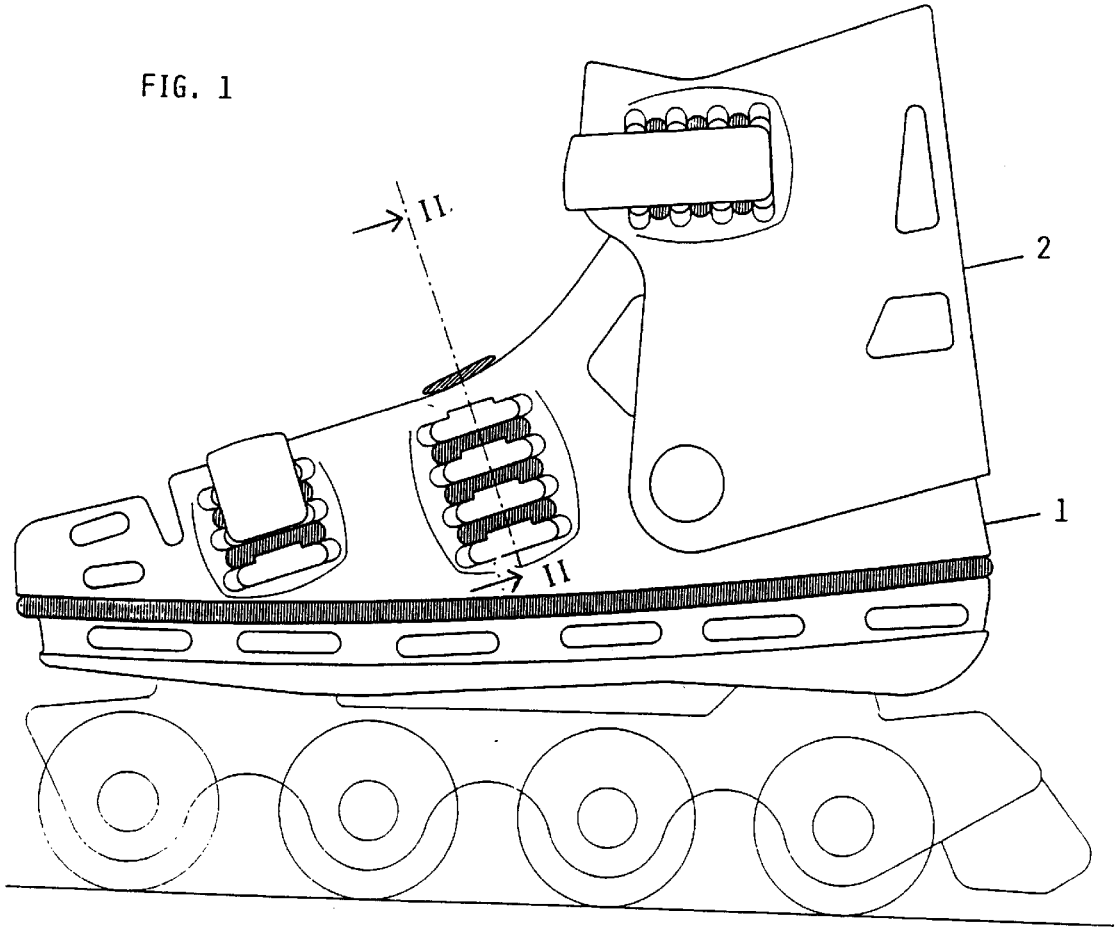
FIG. 1 is a side view of a boot according to the invention.
Figure 3:
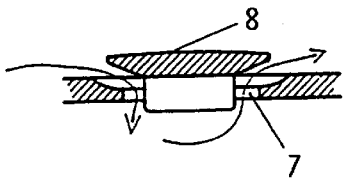
FIG. 3 is a section therethrough on the line III—III of FIG. 2.
Figure 2:
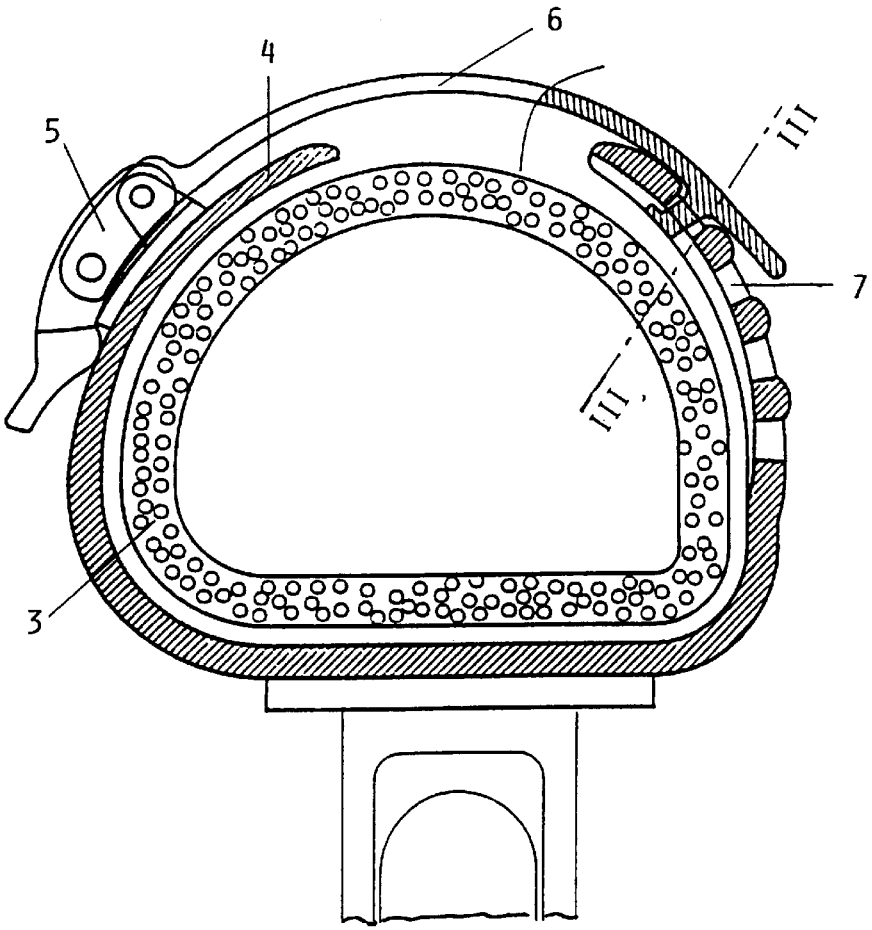
FIG. 2 is a cross-section therethrough on the line II—II of FIG. 1.

As can be seen from the figures, the boot according to the invention comprises substantially a shell 1 to which a leg portion 2 is hinged at the malleoli. The shell internally contains a padding 3 of spongy material.

The boot is of the type comprising sides 4 which can be brought together and/or superposed, on one of the sides there being fixed a plurality of levers 5 for pulling corresponding straps 6.

A plurality of through holes 7 for aerating the boot interior are provided on the other side of the shell, in correspondence with each lever.

Each strap 6 is provided with a flared hooking appendix complementary to the flared shape of the holes 7.

The use of the boot according to the invention is apparent from the drawings, from which it can be seen that when the appendix has been inserted into the predetermined hole 7, the pulling lever 5 is operated to pull the sides 4 together.

If the extent of tightening is not as desired, it is necessary merely to disengage the lever 5, engage the appendix 8 in another hole 7, and then again operate the lever 5.

From the aforegoing it is apparent that the invention has numerous advantages, and in particular:

is of low cost because of the elimination of the pawl-type coupling element provided on one of the vamp sides of traditional boots, facilitates foot transpiration together with aeration of the shell interior because of the shape of the holes.

Figure 4:
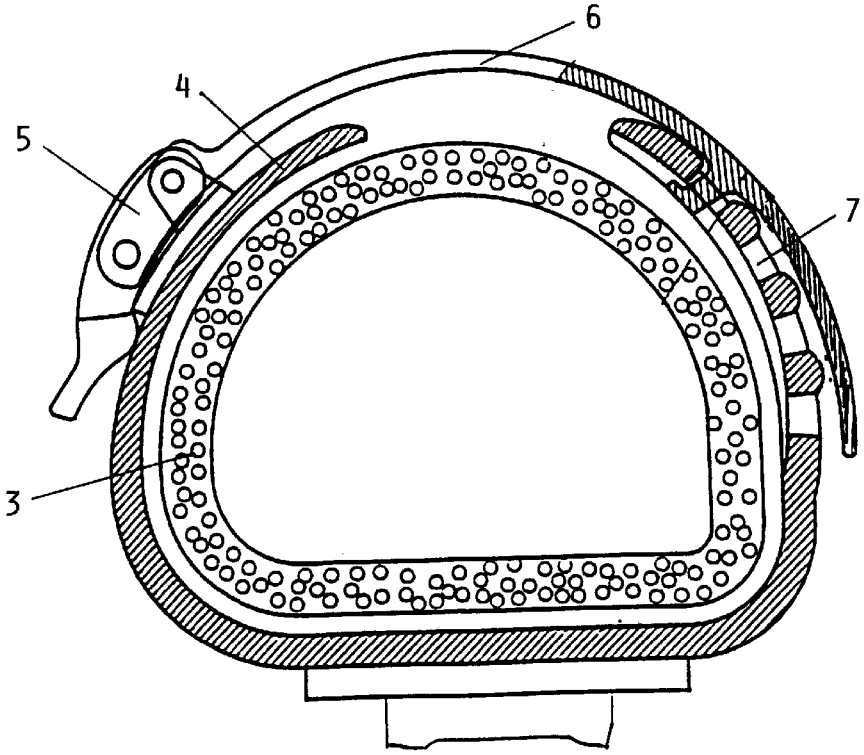
FIG. 4 is a modified embodiment thereof.

In the embodiment shown in FIG. 4, the strap 6 is removably connected to the lever 5 via a traditional coupling member (not shown on the drawings). This facility for disengaging the strap 6 from the lever 5 enables the strap 6 to be replaced during the cold season with a strap of greater length and width, such that when it is engaged in one of the shell holes 7 it covers all the other holes.

I claim:

1. A boot for sporting activities, comprising a vamp having a first side and a second side, a plurality of aeration through holes provided on the first side of the vamp for aerating an interior of the boot, a tractive element connected to the second side of the vamp, the tractive element having an upper and lower surface, an appendix attached to the lower surface of the tractive element, the appendix releasably securing the strap to the aeration through holes, the appendix having a shape complimentary to a shape of the aeration through holes.

2. The boot of claim 1, further comprising a lever connected to the second side of the vamp attaching the tractive element to the vamp.

3. The boot of claim 2, wherein said tractive element is removably connected to said lever.

4. The boot of claim 1, wherein said appendix is flared.

5. The boot of claim 1, wherein said tractive element is a strap.

6. A boot for sport activities, comprising a vamp having a first side and a second side, a plurality of aeration through holes provided on the first side of the vamp for aerating an interior of the boot;

a tractive element having first end and a second end, the first end connected to the second side of the vamp;

an appendix extending from the tractive element for engaging a aeration through hole, the appendix located between the first and second ends of the tractive element, the appendix releasably securing the tractive element to the aeration through holes, the appendix having a shape complimentary to a shape of the aeration through holes.

7. The boot of claim 6, wherein the tractive element is a strap.

8. The boot of claim 6, wherein the strap extends past the appendix to cover the aeration holes.

9. The boot of claim 6, wherein the appendix is L-shaped and has a flared portion.

* * * * *